US008623991B2

(12) United States Patent
Usher, Jr.

(10) Patent No.: US 8,623,991 B2
(45) Date of Patent: Jan. 7, 2014

(54) IPA/POLYESTER COPOLYMER FIBER

(75) Inventor: Robert Alton Usher, Jr., Charlotte, NC (US)

(73) Assignee: David C. Poole Company, Inc., Greenville, SC (US)

( * ) Notice: Subject to any disclaimer, the term of this patent is extended or adjusted under 35 U.S.C. 154(b) by 115 days.

(21) Appl. No.: 12/925,672

(22) Filed: Oct. 28, 2010

(65) Prior Publication Data

US 2011/0098436 A1 Apr. 28, 2011

Related U.S. Application Data

(60) Provisional application No. 61/280,062, filed on Oct. 28, 2009.

(51) Int. Cl.
*C08G 63/02* (2006.01)

(52) U.S. Cl.
USPC ..... 528/308.3; 528/272; 528/302; 528/308.1; 528/308.6; 528/308.8; 428/85; 428/357; 264/104; 525/444

(58) Field of Classification Search
USPC ..... 528/271, 272, 302–308, 308.1, 308.3, 528/308.6, 308.7, 308.8; 264/103; 248/85, 248/357; 525/444; 428/85, 357
See application file for complete search history.

(56) References Cited

U.S. PATENT DOCUMENTS

| | | | |
|---|---|---|---|
| 4,101,274 | A | 7/1978 | Beutler et al. |
| 4,954,398 | A | 9/1990 | Bagrodia et al. |
| 5,297,296 | A | 3/1994 | Moretz et al. |
| 5,945,460 | A | 8/1999 | Ekart et al. |
| 6,093,491 | A | 7/2000 | Dugan et al. |
| 6,506,853 | B2 | 1/2003 | Duan |
| 6,706,842 | B1 | 3/2004 | Duan |
| 6,934,969 | B2 | 8/2005 | Schorr et al. |
| 7,217,456 | B1 | 5/2007 | Rock et al. |
| 2004/0077246 | A1 | 4/2004 | Travelute, III et al. |
| 2007/0231519 | A1 | 10/2007 | Travelute, III et al. |

*Primary Examiner* — Frances Tischler
(74) *Attorney, Agent, or Firm* — Cort Flint

(57) ABSTRACT

A process for producing an IPA/PET copolymer fiber that is homogenous having a substantially level, single IPA copolymer content, said fiber having improved pilling resistance and dye uptake.

6 Claims, 1 Drawing Sheet

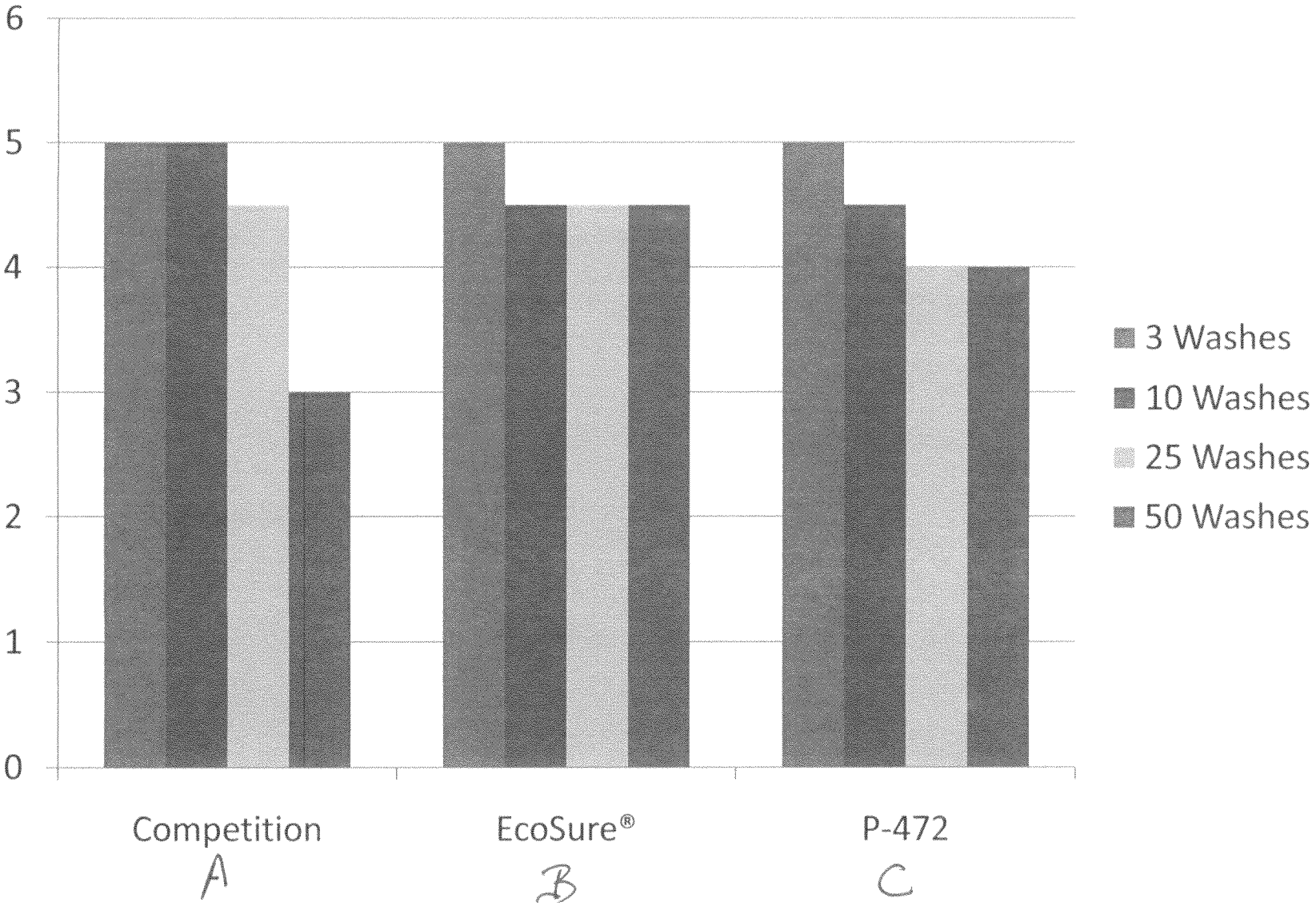
3 Washes
10 Washes
25 Washes
50 Washes
6
5
4
3
2
1
0
Competition
A
EcoSure®
B
P-472
C

IPA/POLYESTER COPOLYMER FIBER

CROSS REFERENCE TO RELATED APPLICATION

This application claims priority from provisional application Ser. No. 61/280,062, filed Oct. 28, 2009 having the same title.

FIELD OF THE INVENTION

This invention relates to fibers from unique copolymers of isophthalic acid (IPA) and polyethylene terephthalate (PET) and to fibers made from homogeneously blended recycled IPA/PET copolymers. More particularly, the invention relates to fibers from said copolymers which have improved dye uptake and reduced pilling.

BACKGROUND OF THE INVENTION

Polyesters are widely used to manufacture textile fibers and in resins to form bottles and containers. For example, U.S. Pat. No. 5,945,460 to Ekart et al. describes one method of using scrap recycled polyester in a polymerization reactor and blending the recycled polyester with virgin polyester; and, in U.S. Pat. No. 6,506,853 which issued to J. F. Duan, a method for making an IPA/PET copolymer is described. The teachings of these patents are incorporated herein by reference. Copolymers of this type are, commonly used resins to make throw away bottles and containers. These thrown away bottles are part of a substantial ongoing collection and recycling process where the bottles are shredded or chopped and used as feed material in extrusion processes. While this recycling process is highly desirable from an environmental and waste disposal point of view, the copolymer content of the polyester used in various recycled bottles is not the same resulting in an uneven and erratic IPA content in products extruded from the recycled material. This limits the use of the recycled resin to principally bottles, or other products where a wide range of physical properties can be tolerated; but, such variations in the co-monomer content have certain drawbacks when used for fiber production.

Accordingly, it is one object of the present invention to provide an IPA/PET fiber product having improved and consistent properties.

Among the inconsistent properties of prior art fiber from recycled resin are lack of level or uniformity in dyeing, unreliable moisture control, and excessive pilling. One method for level dyeing of synthetic material including polyester is described in U.S. Pat. No. 4,101,274 to Helmut Beutler et al. which mentions the use of leveling agents including dispersible polyester.

Accordingly, it is another object of the present invention to provide polyester fiber products that can be dyed with improved uniformity of color with reduced dependency on leveling agents or similar additives.

In the prior art one use of polyester products has been to make a fabric for garments that will wick or remove moisture away from the body. Garments and fabrics which do this are described in U.S. Pat. Nos. 4,954,398, 5,297,296, and 6,093,491. In these patents and other prior art publications, shaping of the fiber to provide moisture transport channels has been one way of achieving the desired moisture transfer.

One more object of the present invention is to provide a polyester fiber that does not require shaping or change of cross-section of the fiber in order to transport moisture.

The foregoing and other objects are achieved by the invention described below.

SUMMARY OF THE INVENTION

In IPA/PET copolymer and homo-polymer fibers, properties such as resistance to pilling and dyeing consistency can be less than desirable. However, it has been surprisingly discovered that by controlling the copolymer level, that is, keeping the IPA content substantially constant so that the copolymer is uniform and homogenous throughout a batch, that certain desirable properties are unexpectedly improved.

Not only is control of the copolymer level in recycling processes beneficial, such control also produces unexpected improvements in properties when making fibers from virgin resin. A particularly useful range of IPA co-monomer content is from about 0.8% to about 12% by weight and within this range the obtainable, desirable properties can be grouped. In a lower part of this range, particularly, 0.8% to 6%, one preferred embodiment has a 4% IPA content. By precisely controlling the IPA content to 4%, certain properties are significantly improved. It is believed that by controlling the co-monomer content at a precise level the co-monomer is uniformly spaced or distributed along the polymer chain so that regularly spaced sites for receiving dye are available. The regular and uniform arrangement of dye sites translates into a uniform level of dye absorption or attachment at the site. Likewise, it is believed that the uniform spacing provided by constant monomer level presents a uniformity in distribution that results in a higher modulus. The moisture transport is very good at this level but not quite to the excellent degree that occurs in slightly higher IPA content. It is believed that rather than using the shape of the fiber to transport moisture that the uniform distribution of co-monomer increases surface tension and imparts hydrophobic properties to the fiber so that the moisture will not be absorbed and will quickly move out of any fabric woven with the fibers.

In the range of about 6% to about 12%, IPA/PET copolymer that is a particularly preferred embodiment is one having about 6%, IPA. Again, the co-monomer content should be precisely held to the 6% level. In this range the moisture transport is improved, that is, the surface tension of the fabric fibers increases and provides a more hydrophobic effect so that moisture is even more rapidly wicked out of a fabric made with the IPA/PET co-polymer having the higher co-monomer content.

Accordingly, in one aspect, the invention is a process of providing a polyester copolymer comprising IPA and virgin PET having improved properties comprising the steps of selecting a weight level of IPA to maintain in said copolymer, said selected weight level being in the range from about 0.8% to about 12% of the total copolymer weight; copolymerizing the IPA and PET to form a copolymer of the selective weight level, and forming fibers from the formed copolymer.

In another aspect, the copolymerization step of the present invention is performed by continuous polymerization.

In still another aspect, the copolymerization step is performed by batch polymerization.

In yet another aspect, the selected range of IPA content is from about 0.8% to about 6%.

In a further aspect, the selected range of IPA is from about 6% to about 12%.

In a still further aspect, the present invention is a process for making a fiber and a fiber product from a batch of flakes from recycled soda bottles and similar containers which are made from relatively pure PET copolymer having a low IPA content preferably in the range of about 0.8% to about 2.0%. The recycled material is preferably provided in batches in flake form, for example, in batches in bags of up to about 2,500 pounds or more, which are sampled for IPA content and tumble blended with flakes from at least about 200 bags or more to form a master batch of at least 500,000 pounds or more so that the IPA content is essentially the same and the master batch is virtually homogeneous. A preferred batch size is about 2,000,000 pounds. A viscosity test is used to determine the IPA content in the copolymer blend. Within a master batch the IPA content is preferably 1.4%, +/−0.45% and from master batch to master batch the variance is controlled to be within +/−0.65%. The blend is melt extruded in the range of 280° C. to 300° C., preferably at about 282° C., through a spinneret die to produce fibers. The fibers, being homogenous and having essentially the same IPA content throughout, will have uniform properties such as improved dye uptake and high resistance to pilling.

IN THE DRAWINGS

Attached hereto and made a part of this disclosure by way of illustration and not limitation is:

FIG. 1 is a bar graph comparing results of a pilling test.

DETAILED DESCRIPTION

Generally, polyester polymer is produced by the reaction of ethylene glycol and terephthalic acid or its derivatives. Fiber forms which can be produced from the polymer are filaments, staple, and tow. Polymerization is accomplished using an ester of dihydric alcohol and terephthalic acid. Traditionally, polyester filaments are produced by forcing the molten polymer at a temperature of about 290° C. through spinneret holes followed by air cooling, combining the single fiber into yarns, and drawing or stretching the yarns several times their original length to orient the long chain molecules and gives the fibers, and consequently the yarn, strength.

In one process in the prior art for continuous copolymerization wherein, for example, terephthalate acid and ethylene glycol are fed into a polymerizer of a type well-known in the art, and as polymer is produced, the solid product is moved to a chipper, then moved to a melting stage, next to an extruder and extruded through a spinneret die for melt spinning to produce the fiber.

In the continuous process described above, in one preferred aspect, the isophthalic acid (IPA) and glycol are combined in a reactor with terephthalic acid with the IPA being held at the selected level to provide the IPA/PET polymer of the invention. In. a preferred embodiment and a best mode, the mole percentage of IPA is held in the range of 1.8%-2.0% which yields a level of 1.4%-1.8% IPA by weight. The precisely controlled copolymer is then chipped, melted and extruded to form fibers. This copolymer is designated as a virgin resin.

In one example, fiber made from one of such resins in designated P-472 which has about 1.7% IPA. This fiber was made into a hosiery knit fabric. In one comparison, illustrated in FIG. 1 where the results of pilling tests are shown in a bar graph, P 472 fabric (C) shows superior results to a fabric of PET not a copolymer (A), which represents fiber used commercially.

Pills are the undesirable little balls of fiber on the surface of a fabric that significantly detract from the appearance of the fabric. The test results shown in FIG. 1 were obtained from tests conducted according to AATCC/ASTM TS-008 procedures in which the test fabric sample were 1.2 denier, 38 mm long of dyed hose knit which were abraided after each of the wash cycles, i.e. after 3, 10, 25 and 50 wash cycles. No pilling is represented by the number 5 and 1 indicates severe pilling. As can be seen, with 3 and 10 wash cycles there is little difference between the test results but at 50 wash cycles the knit samples of P-472 showed less pilling, the difference being between 3 and 4 on the graph. A difference of 1 unit is visibly significant.

The samples knitted from EcoSure® yarn (B) demonstrated the best pilling resistance as shown in FIG. 1. In a preferred embodiment and best mode, the EcoSure® yarn, which was prepared from IPA/PET recycled bottle flake in very large flake batches, e.g. in the range from several hundred thousand pounds up to one million pounds and more. The flake contains 0.8% to 1.4% IPA and was tumble blended to produce a homogenous blend. Then, the batch was fed to an extruder to be melted and extruded as yarn. Not only do samples of knitted fabric (B) show significant pilling resistance, fabrics according to the invention, in tests, have shown 20% to 25% greater dye uptake when compared to a homopolymer fabric.

Having described my invention using the embodiments described above, it is understood that it is not limited to such embodments but is limited only by the scope of the attached claims.

I claim:

1. A process of providing a copolyester fiber with improved pilling resistance and dye uptake comprising a copolyester copolymer having isophthalic acid, terephthalic acid and glycol moieties in which all of said copolyester copolymer has substantially the same isophthalic acid content, comprising the steps of: a) selecting a level weight proportion of isophthalic acid to maintain in said copolymer, said level weight being in the range of about 0.8% to about 12% of the total copolymer weight; b) providing isophthalic acid, terephthalic acid and glycol; c) copolymerizing the isophthalic acid, terephthalic acid and glycol while controlling the proportion of isophthalic acid and terephthalic acid to constantly maintain the selected weight level while forming the copolymer; and d) forming fibers from said copolymer whereby a fiber with improved piling resistance properties is produced and wherein fabrics produced from said fibers have 20% to 25% greater dye uptake when compared to a homo-polymer fabric.

2. The process of claim 1 wherein the copolymerizing step is performed by continuous polymerization.

3. The process of claim 1 wherein the copolymerization step is preferred by batch polymerization.

4. The process of claim 1 wherein the isophthalic acid level is in the range from about 1.4% to about 1.8% of the total copolymer weight.

5. The process of claim 4 wherein the selected isophthalic acid level is about 1.7% of the total copolymer weight.

6. The process of claim 1 wherein the selected isophthalic acid level is about 6% of the total copolymer weight.

* * * * *